United States Patent [19]

Landry, Jr.

[11] 4,417,842

[45] Nov. 29, 1983

[54] SOIL EROSION PREVENTION BLOCK INSERT AND APPARATUS FOR POSITIONING

[76] Inventor: Kossuth J. Landry, Jr., P.O. Box 599, Channelview, Tex. 77530

[21] Appl. No.: 204,055

[22] Filed: Nov. 4, 1980

[51] Int. Cl.[3] ..... E02B 3/12

[52] U.S. Cl. ..... 414/572; 104/122; 298/1 R; 405/20; 414/303; 425/126 R

[58] Field of Search ..... 414/42, 82, 83, 222, 414/403, 404, 458, 459, 749, 750, 787, 303, 572; 294/67 R, 67 BB, 67 BC, 87 R; 104/3, 6, 122; 52/749; 405/20; 425/126 R; 298/1 R

[56] References Cited

U.S. PATENT DOCUMENTS

| | | | |
|---|---|---|---|
| 1,007,663 | 11/1911 | Atterbury | 294/67 R |
| 1,632,286 | 6/1927 | Graham | 425/126 |
| 1,956,967 | 5/1934 | Upson | 405/20 |
| 2,310,512 | 2/1943 | Buller | 294/87 R X |
| 2,706,057 | 4/1955 | Belding | 414/459 |
| 2,754,555 | 7/1956 | Young | 414/749 X |
| 4,227,829 | 10/1980 | Landry | 405/20 |

*Primary Examiner*—Leslie J. Paperner
*Attorney, Agent, or Firm*—Guy E. Matthews

[57] ABSTRACT

An apparatus for aligning and loading inserts for soil erosion prevention blocks having a rollable main frame with an insert holder frame movably coupled thereto. Secured within the insert holder frame is an aligning frame which receives the inserts and aligns them in the desired manner. The inserts are supported within the insert holder frame by a plurality of hooks affixed to movable rods, such rods preferably tied together such that the rods may be moved simultaneously, causing the hooks to release the inserts uniformly.

5 Claims, 5 Drawing Figures

SOIL EROSION PREVENTION BLOCK INSERT AND APPARATUS FOR POSITIONING

The invention relates generally to manufacture of soil erosion prevention blocks used to prevent erosion along banks and other inclined areas. More particularly, the invention relates to a novel insert for molding into a concrete soil erosion prevention block, such as the soil erosion prevention block disclosed in my U.S. Pat. No. 4,227,829, issued Oct. 14, 1980, which is hereby incorporated by reference herein, and apparatus for loading and positioning the novel inserts in a casting machine during forming of the soil erosion prevention blocks.

Soil erosion prevention blocks are known in the art, as shown by my above mentioned U.S. patent, to which the present invention particularly relates as shown herein. It is preferable that the blocks be securely connected together by cable, rope, or the like through the blocks to form a matrix of such blocks which is easily transported and positioned and anchored in place by means engaging the cable through the blocks. It is therefore preferable that the blocks include molded-in passageways comprising a tube or the like of a material relatively stronger than the block, to accept the cable. The passageways are preferably parallel to the bottom surface of the blocks.

In the construction of soil erosion prevention blocks, it is therefore important that an integral insert be provided around which a block may be cast or formed which will define passageways through the block having the above mentioned characteristics. Further, it is important that an apparatus be provided which is adapted for positioning and depositing such inserts within the casting head of a typical concrete casting machine, and which will receive the number of inserts appropriate for the mold employed, retain the inserts in the correct alignment as the apparatus is moved into the casting machine, and release the inserts in the precise position in the casting head to permit perfect blocks to be formed when the mold is positioned around the inserts and concrete poured to form the block therein.

SUMMARY OF THE INVENTION

The present invention is directed to a novel insert moldable into a soil erosion prevention block to provide the passageways therethrough to interconnect the blocks. The insert is composed of tubes of the desired material which are interconnected and retained in the position desired for the passageways through the block by means of a novel clip. The clip is formed of a resilient spring-like material and has openings through it so that when the clip is bent, a tube may be placed through the openings and upon release of the clip the edges of the openings securely engage the tube and the clip is retained in a concave configuration. A second tube is inserted between the clip and the first tube to form a cross or T configuration as desired. Another tube and clip are attached to the second tube to form the complete insert, the length and spacing of the tubes being dependent upon the size of the soil erosion prevention blocks desired.

An apparatus for positioning and depositing the completed inserts within the head of a concrete casting machine is also disclosed. The apparatus includes an aligning frame which receives an insert and maintains it in the desired position. Releasable hooks engage the tubes of the insert to hold it within the aligning frame until the insert is correctly positioned within the casting head. The apparatus accomodates a plurality of aligning frames thereby allowing a number of inserts to be positioned therein and moved with the apparatus into the casting machine. Once properly positioned in the casting head, the releasable hooks are disengaged from the inserts, which drop a slight distance and remain in the casting head. The apparatus includes means for raising the aligning frames to prevent their touching and disturbing the inserts as the apparatus is removed. A plurality of inserts are thereby accurately located in the casting head whereupon the mold section of the machine may be lowered over the inserts and concrete deposited in the mold and around the inserts to form a soil erosion prevention block having the desired passageways through it.

DETAILED DESCRIPTION OF THE INVENTION

Figure 1:
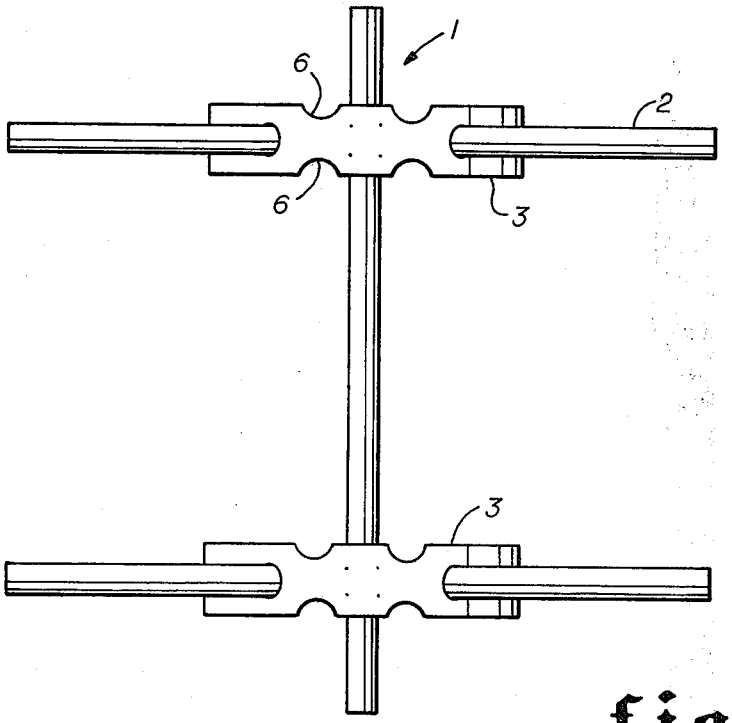
FIG. 1 is a top view of the insert of the invention.
Figure 2:
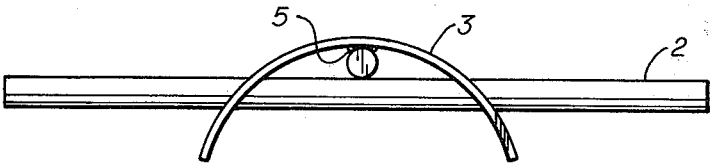
FIG. 2 is a side view of the insert of the invention.
Figure 3:
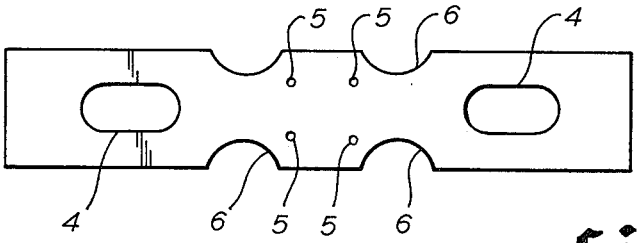
FIG. 3 is a top view of the spring plate of the invention.

Referring now to the drawings, the soil erosion prevention block insert of the invention is indicated generally by reference numeral 1 in FIG. 1. The insert 1 illustrated is the preferable embodiment for the soil erosion prevention block of my U.S. Pat. No. 4,227,829. The insert 1 comprises three tubes for receiving cables through the blocks (not shown). The tubes may be constructed from any desired material, but are preferably stronger than the concrete which will be molded around them and resistant to the chemical effects of concrete. If desired, the tubes may have enlarged or flared ends to simplify insertion of the cable. The tubes are maintained in cross configuration by a plurality of resilient spring plates 3, which may be any material having the desired spring characteristics, but which are preferably metal. The spring plates are preferably elongate and relatively thin to allow them to be easily bent. Oblong openings 4 are formed through the spring plate to accomodate a tube when the plate 3 is bent. As best seen in FIG. 3, the insert is assembled by bending the spring plate 3, and inserting a tube 2 through the oblong openings 4. A second tube is positioned between the spring plate and the first tube and the plate 3 is released. The second tube is thereby securely retained between the first tube and the spring plate. The length of the spring plate extending past the oblong openings 4 determines the height of the insert 1 on the casing and the position of the tubes in the block, which is naturally a function of the block size.

It is preferable that the spring plate 3 includes a number of downward projections or dimples in the spring plate approximately centrally of the openings 4. The curved surface of the cross tube is engaged by the projections 5 which prevent the cross tube from slipping or skewing with respect to the tube 2 through the spring plate 4. As is apparent, the length of the projections 5 and the spacing therebetween is a function of the tube size. The projections may be formed when a spring plate is manufactured by impressing a die thereon.

It is preferred also that the spring plate include openings 6 which are notches or cut outs in the plate material between the openings 4 and the projections 5. The openings 6 aid in the molding of soil erosion prevention blocks by permitting the concrete mix to migrate under the spring plates during the molding process. A more solid and stronger block is thereby obtained. Further, when a concrete mix is used to form the blocks, the opening 6 are particular useful in permitting the aggregate to flow under the spring plate.

The soil erosion prevention block inserts of the invention are preferably integral with the block and molded therein. Soil erosion prevention blocks may be manufactured by means of a typical concrete molding machine (not shown). Such a machine comprises a planar casting bed on which a pellet or the like is placed. A mold head is provided in the machine, which is an integral assembly of a plurality of molds, each corresponding to a single soil erosion prevention block. In the typical configuration such molds are open on the bottom, having an inner surface corresponding to the outer surface of the block, and are open at the top for insertion of the concrete. The mold head is lowered to the pallet surface and concrete is deposited through the openings in the top of the mold head to fill the individual molds and form the blocks. In order to form a soil erosion prevention block having the insert of the invention integrally molded therewith it is necessary that a plurality of the inserts of the invention be positioned under the mold head so that when the head is lowered, the inserts will be within the molds for each block. When concrete is introduced into the molds it will thereby flow around and over the inserts to form a soil erosion prevention block with an integral insert.

Referring now to the drawings, an apparatus in accordance with the invention for accurately placing a plurality of soil erosion prevention block inserts under the mold head of a molding machine is indicated by reference numeral 10. The apparatus comprises generally a main frame 11 and an insert holder frame 12. The main frame is adapted to carry the insert holder frame 12, as will be described in more detail below. The main frame includes wheel brackets 14 attached at approximately each corner thereof by welding or other suitable means. Wheels 13 are mounted with the frame by means of a plurality of bearing shaft bolts, as are well known, threadably engaging with the wheel brackets 14. The apparatus is preferably constructed of aluminum, which is easily fabricated and provides a sturdy and light weight structure.

Figure 5:
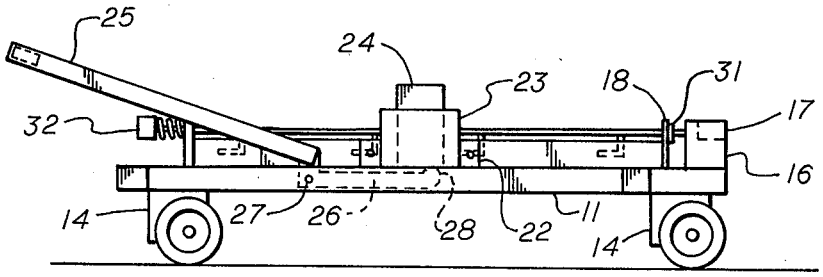
FIG. 5 is a side view of the insert positioning apparatus of the invention.

As best seen in FIG. 5, the front end of the frame is preferably raised to clear the inserts after they are placed on the casting bed, as well be described in more detail later. The front of the frame is raised by means of two struts 16 affixed to the front of the frame by welding or other suitable means and a raised cross bar 17, which is fixed adjacent the top of the struts 16 to provide a laterally stable, rigid main frame 11.

Figure 4:
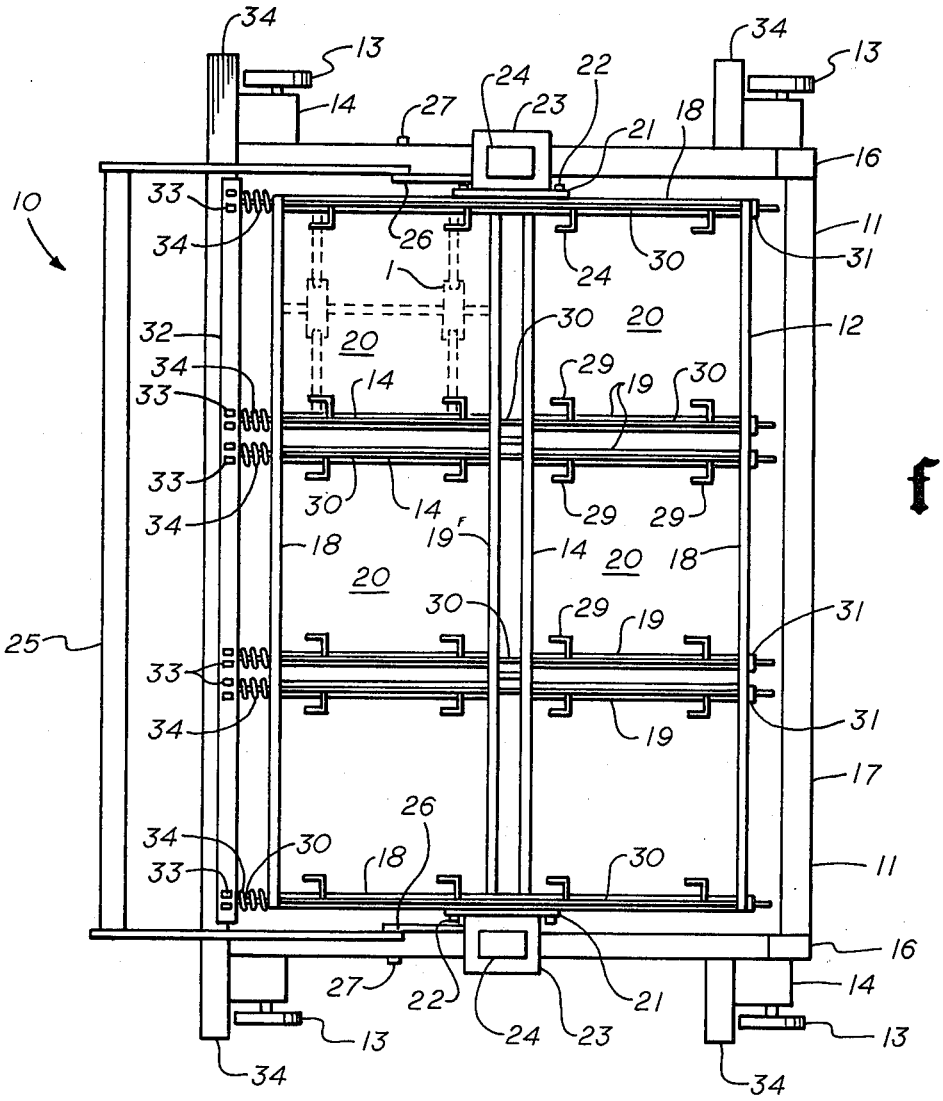
FIG. 4 is a top view of the insert positioning apparatus of the invention.

The insert holder frame 12 in the preferred embodiment is preferably rectangular, however, the size and shape of the insert holder frame is mainly dictated by the configuration and placement of the mold voids in the molding machine casting head. The insert holder frame includes four side bars 18, which may be rectangular or aluminum bar stock welded end to end to form a sturdy unit. In the preferred embodiment, eight cross bars 19, and two lateral cross bars 19' which also may be rectangular aluminum bar stock are mounted with the side bars 18 by any suitable means to define a plurality of aligning frames 20. It is to be understood that the dimensions of the aligning frames 20 and thus the dimensions of the insert holder frame 12 are dependent upon the size of the block inserts and the configuration of the casting head for which the apparatus is intended. The aligning frames 20 are preferably dimensioned to receive an insert 1, as best seen in FIG. 4, such that the insert is prevented from moving back to front or side to side but will drop free of the aligning frame when it is released from the apparatus. It has been found that a clearance of 1/16 inch front to back and side to side between the insert and the aligning frame provides the desired effect.

The insert holder frame 12 includes guide brackets 21 mounted with the insert holder frame 12 such as by bolts 22. Guides 23 are provided fixed to the guide brackets 21 by welding or other means and include an opening therethrough for receiving guide shafts 24. The guide shafts 24 are securely fixed to the main frame 11 and are preferably rectangular stock. It is also preferable that guides 23 be formed from rectangular tube so that the insert holder frame 12 is constrained to move up or down with respect to the main frame 11 without any forward or backward tilting.

The insert holder frame 12 is moved with respect to the main frame 11 by means of a lifting handle 25. In the preferred embodiment, the lifting handle 25 is fixed to a pair of offset arms 26 pivotally mounted on either side of the main frame 11 by means of bolts 27 or the like. As best seen in FIG. 5, the offset arms include a cam end 28 engaging the bottom of the guides 23 to urge the insert holder frame 12 upwardly when the lifting handle 25 is depressed. The cam end 28 of the offset arms preferably includes a rounded or convex surface where it contacts the guides 23 to permit lifting of the insert holder frame 12 to proceed smoothly.

The inserts 1 are retained in the alignment frames 20 by a plurality of generally L shaped hooks 29. The hooks are provided securely affixed to a plurality of releasing rods 30, such that an insert placed in an aligning frame 20 is engaged and retained therein by the hooks 29. The release rods 30 are slidably mounted for front to back movement with respect to the insert holder frame 12 by any suitable means, however, in the preferred embodiment the front and rear side bars 18 and at least one of the lateral cross 19' are offset upwardly with respect to the left and right side bars 18 and the cross bars 19. The release rods 30 are disposed through holes drilled in the front and rear bars 18 and at least one of the lateral cross bars 19', as best seen in FIG. 5. In order that the release rods 30 not interfere with placement of an insert 1 within an aligning frame 20, it is preferable that the release rods be disposed above the side bars 18 and the cross bars 19, so that the rods do not interfere with placement of an insert within the aligning frame.

A number of stops 31, which may be cable clamps or their equivalent, are attached to the fronts of the release rods 30 to limit their backward movement. A release handle 32 is provided mounted with the opposite ends of the release rods 30 by any suitable means, such as for example U-bolt clamps 33 or the like. Springs 34 or other biasing means are preferably mounted over the release rods 30 between the insert holder frame 12 and the release handle 32 to urge the release handle 32 away from the frame.

It is apparent that a number of inserts 1 may be placed in and carried by the apparatus onto the casting bed whereupon the inserts may be released by merely pushing the release bar 32 toward the insert holder frame 12, causing the hooks 29 to disengage and release the inserts. It is apparent that the apparatus of the invention is adaptable to various casting machines and it may be desirable to provide typical height adjusting means at, for example, the wheel brackets 14 or elsewhere to permit the height of the insert holder frame 12 above the casting bed to be adjusted. However, it is preferable that the apparatus be dimensioned such that the inserts 1 when released on the casting bed must drop only a very small distance to avoid disturbing their accurate placement.

It is preferable that the apparatus of the invention be mounted to roll on a track (not shown) leading into the casting machine. Such a track may be constructed of angle iron or channel receiving the wheels, as is known, to prevent side to side movement of the apparatus as it is rolled from a position where the inserts are loaded into the insert holder frame to the position over the casting bed where the inserts are released. Stop plates 34 are preferably provided fixed to the main frame to stop the apparatus at the location at which the inserts, when released, will be correctly positioned for coverage by the casting head of the casting machine. As the dimensions of concrete casting machines and molds may vary, the dimensions of the apparatus of the invention must naturally conform to those variables to accurately place the inserts. The choice of such dimensions is easily obtained by merely acquiring dimensions or drawings of the casting machine and molds to be employed.

In operation, the apparatus of the invention is at its starting position, away from the casting machine, and loaded with inserts. It is wheeled along its track into the casting machine until the stops 34 contact the part of the machine desired which places the inserts in the correct position for molding. Naturally, the stops 34 are positioned on the main frame 11 so that accurate placement is accomplished. In this regard, it may be necessary to attach brackets, or the like, to the casting machine to engage the stops 34 for accurate locating of the apparatus, as is well known. When the apparatus is in its stopped position, the release handle 32 is pushed inwardly, which releases the inserts from the hooks. The lift handle 25 is then depressed, raising the insert holder frame 12 to avoid its contacting and disturbing the inserts 1 as the apparatus is wheeled from the casting area. As previously mentioned, the front of the main frame 11 of the apparatus of the invention is raised, which likewise prevents contact between the main frame 11 and the inserts.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with references to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for aligning and loading inserts for soil erosion prevention blocks, comprising:

a rollably movable main frame;

an insert holder frame movably coupled to said main frame, said insert holder frame adapted for movement between a first position, wherein said inserts are supported by said frame, and a second position, wherein said inserts are positioned for casting into soil erosion prevention blocks;

at least one aligning frame formed within said insert holder frame for receiving at least one of said inserts;

at least one hook movably coupled with said insert holder frame for engaging and retaining said at least one insert in said aligning frame; and means for moving said hook from a first engaged position wherein said hook engages said insert for movement with said insert holder frame to a second released position wherein said hook disengages said insert and said insert holder frame is movable independently of said insert.

2. The apparatus as set forth in claim 1 comprising means for moving said insert holder frame from a first lowered position relative to said main frame to a second raised position relative to said main frame.

3. The apparatus as set forth in claim 1, further comprising at least one release rod slideably mounted with the said insert holder frame wherein said hook is secured to said release rod and wherein said release rod is movable between a first position wherein said hook engages and retains said insert and a second position wherein said hook releases said insert.

4. The apparatus as set forth in claim 3, wherein said at least one release rod comprises a plurality of said release rods and a plurality of said hooks secured thereto.

5. The apparatus as set forth in claim 3 comprising a release bar fixed to a first end of each of said plurality of release rods, a plurality of rod stops mounted to a second end of each of said plurality of release rods, and means for moving said plurality of release rods between said first position and said second position, whereby moving said release bar moves said release rods with said hooks to release said inserts.

* * * * *